United States Patent [19]

Spagnola, Jr.

[11] 4,113,143

[45] Sep. 12, 1978

[54] BINGO CHIP DISPENSER

[76] Inventor: Raymond J. Spagnola, Jr., 707 Moore Ave., Campbell, Ohio 44405

[21] Appl. No.: 773,782

[22] Filed: Mar. 2, 1977

[51] Int. Cl.[2] ..... B65G 59/06

[52] U.S. Cl. ..... 221/267; 133/5 A

[58] Field of Search ..... 133/5 R, 5 A, 5 B, 6; 221/64, 65, 279, 280, 232, 226, 267, 307, 250; 206/0.8, 0.81, 0.82

[56] References Cited

U.S. PATENT DOCUMENTS

| | | | |
|---|---|---|---|
| 2,294,001 | 8/1942 | Ritter | 221/279 |
| 2,431,121 | 11/1947 | Hunter | 221/279 |
| 2,885,110 | 5/1959 | Tregilgas | 221/267 |
| 3,998,238 | 12/1976 | Nigro | 133/5 A |

*Primary Examiner*—Allen N. Knowles
*Assistant Examiner*—H. Grant Skaggs
*Attorney, Agent, or Firm*—Webster B. Harpman

[57] ABSTRACT

A dispenser for chips or coins includes a cylindrical body and a plunger for moving the chips out of an open end of the body. The open end of the body is formed as a thin distortable ring having at least a pair of oppositely disposed detents thereon against which the chips or coins are normally engaged. A movable collar surrounds the lower end and the distortable ring and alternately spaces the distortable ring from a supporting surface so that a single chip or coin may be dispensed therefrom or permits the distortable ring to engage the supporting surface about a chip or coin to be reinserted in the device.

5 Claims, 4 Drawing Figures

BINGO CHIP DISPENSER

BACKGROUND OF THE INVENTION

1. Field of the Invention

This invention relates to dispensing devices such as employed to hold and dispense coins or tokens and chips such as used in bingo games and the like.

2. Description of the Prior Art

Prior structures of this type have been proposed and a typical example may be seen in U.S. Pat. No. 2,431,121 wherein a cylindrical body formed of rigid material is provided with circumferentially spaced axially extending slots to provide a somewhat yieldable structure. The present invention forms the chip or coin retaining detents on a distortable annular ring so that pushing the coin or chip past the detents moves the normally annular ring into an oval shape. The construction is simpler in design, easier to form and does not require a cutting operation to form the slots of the prior art as heretofore believed necessary.

SUMMARY OF THE INVENTION

A bingo chip dispenser includes a cylindrical body and a plunger movable through an apertured cap arranged to push chips or coins in the body out of an open end thereof, the open end is provided with inwardly extending detents on a distortable ring normally circular and joined to the cylindrical body by a thin flexible section of resilient material so as to permit the annular ring to move to a distorted shape when the bingo chips or coins are moved past the detents.

DESCRIPTION OF THE PREFERRED EMBODIMENT

Figure 1:
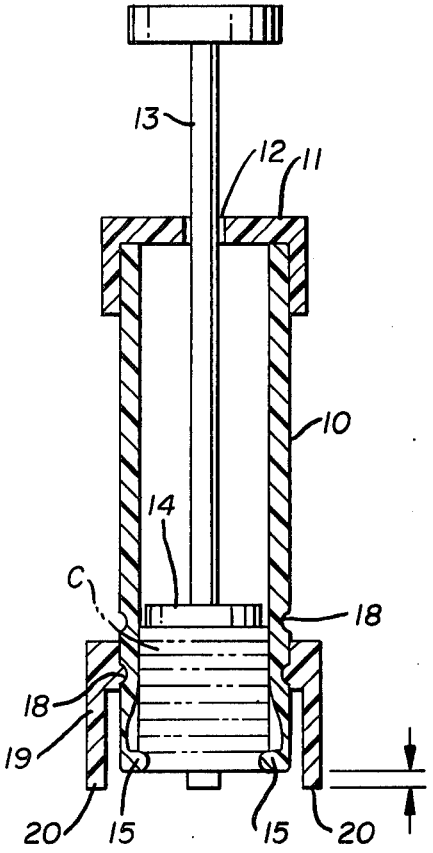
FIG. 1 is a vertical section showing the dispenser holding coins or chips therein.

In the form of the invention chosen for illustration and description herein the bingo chip dispenser as seen in FIG. 1 of the drawings comprises a cylindrical body member 10 having a closure 11 at its uppermost end which is centrally apertured as at 12 so as to receive a plunger 13 therethrough in movable relation. A piston 14 on the lower end of the plunger 13 is normally engaged upon the upper one of a plurality of bingo chips C arranged in superimposed relation within the cylindrical body with the lowest one of the chips C resting on a pair of oppositely disposed detents 15 formed on an annular ring-like bottom portion 16 which is thin and flexible and extend above the detents as at 17 a sufficient distance to permit the bottom ring-like portion 16 to flex inwardly and outwardly and thereby permit the detents 15 to move outwardly oppositely to enable the chips C to be moved thereby as best shown in FIG. 2 of the drawings.

Still referring to FIG. 1 of the drawings, it will be seen that the exterior of the cylindrical body 10 is provided with a pair of annular grooves 18 which may be a spiral thread pattern and a collar 19 having a mating annular rib configuration on its inner surface is engaged thereon so as to be movable longitudinally of the cylindrical body member 10. The lower portion of the collar 10 is preferably shaped so that it provides a series of circumferentially spaced legs 20 or alternately it may be solid.

Figure 2:
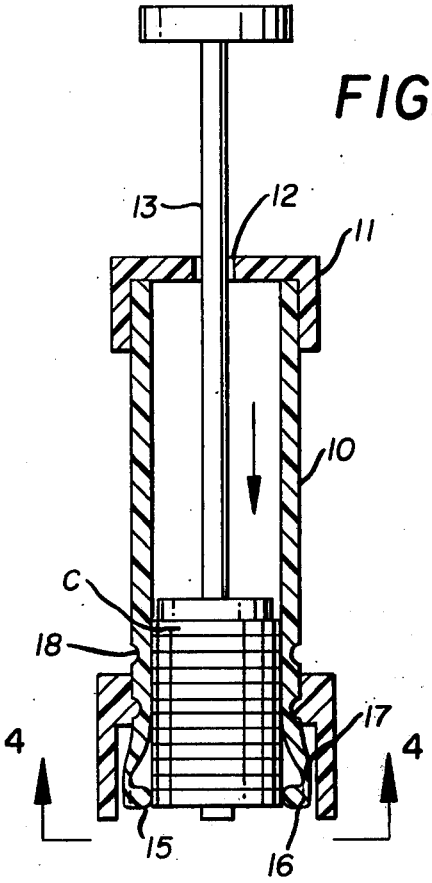
FIG. 2 is a vertical section similar to FIG. 1 showing coins or chips being moved past the detents and distorting the ring carrying the same.

As shown in FIGS. 1 and 2 of the drawings, the collar 19 is in lowermost position on the cylindrical body member 10 thereby spacing the ring-like portion 16 of the body 10 and the detents 15 upwardly with respect to a supporting surface on which the legs 20 may be positioned. In such position, as shown in FIG. 2 of the drawings, pressure on the upper end of the plunger 13 will push the lowermost one of the chips C downwardly against the inner tapered surface of the detents 15 and cause the same and the ring-like portion 16 to move outwardly creating an oval shape of the ring-like portion 16 and permitting the lowermost one of the chips C to move past the same and be deposited on a supporting surface as there is sufficient space beneath the detents 15 and the bottom of the legs 20 to accommodate one of the chips C. Thus the device may be quickly and easily moved from one location on a bingo card or the like and the bingo chips quickly and easily dispensed as desired in several locations.

Figure 4:
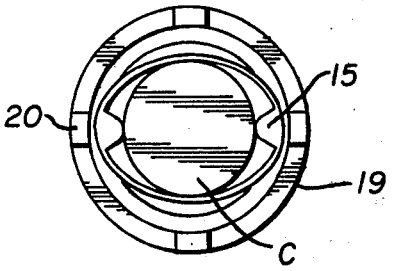
FIG. 4 is a horizontal view on line 4—4 of FIG. 2 showing the distortion of the annular ring portion of the device.

By referring now to FIG. 4 of the drawings a bottom view on line 4—4 of FIG. 2 may be seen to illustrate the distortion of the lower ring-like portion 16 of the cylindrical body member 10 and the detents 15 thereof as compared with the circular shape of the chips C shown therein.

Those skilled in the art will observe that the material from which the cylindrical body member is formed is sufficiently resilient to permit the changes in shape necessary as occasioned by the operation as hereinbefore described.

Figure 3:
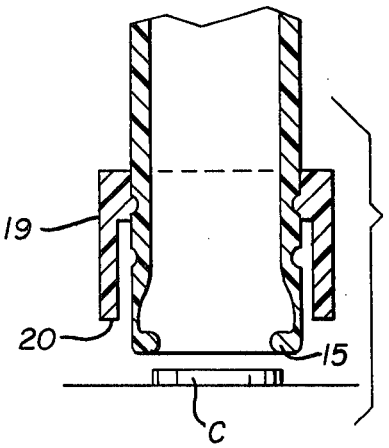
FIG. 3 is a vertical section with parts broken away and showing a supporting surface and a bingo chip positioned for insertion in the device.

By referring now to FIG. 3 of the drawings, the bingo chip dispenser may be seen with the collar 19 in uppermost position so that the ring-like portion 16 comprising the lower end of the cylindrical body 10 may be directly engaged against a bingo chip to be reinserted into the device by simply moving the ring-like portion and the detents 15 downwardly against the chips C, the ring will distort, the detents will move outwardly and permit the chip to move upwardly into the dispenser body member 10.

It will thus be seen that the bingo chips may be readily picked up from a bingo card by simply moving the collar 19 upwardly and then forcefully engaging the dispenser on each of the plurality of chips to be picked up. After the chips have been reinserted in the dispenser the collar 19 is moved to lower position as illustrated in FIGS. 1 and 2 of the drawings and the device is again ready for dispensing one chip at a time.

The above described structure provides an easy and convenient method of handling bingo chips and the like and although but one embodiment of the present invention has been illustrated and described it will be apparent to those skilled in the art that various changes and modifications may be made therein without departing departing from the spirit of the invention.

Having thus described my invention what I claim is:

1. A bingo chip dispenser comprising a cylindrical body member open at one end and having a plunger movably positioned therein and extending out of the opposite end, a cylindrical thin wall portion on said cylindrical body member adjacent said open end defining a continuous ring-like member, a pair of oppositely disposed inwardly extending detents formed on said ring-like member, said ring-like member being distortable from a normally circular shape to an oval shape whereby bingo chips in said dispenser may be moved past said detents by said plunger and means on said cylindrical body normally spacing said ring-like member and the detents thereon above a supporting surface on which said chips are to be dispensed.

2. The bingo chip dispenser set forth in claim 1 and wherein the means spacing the cylindrical body from said supporting surface comprises a collar, configurations on said cylindrical body member and mating configurations on said collar for selective engagement therewith.

3. The bingo chip dispenser set forth in claim 1 and wherein an apertured closure is positioned on said opposite end and said plunger extends through the apertured closure.

4. The bingo chip dispenser set forth in claim 1 and wherein said means normally spacing said ring-like member above said supporting surface comprises a pair of vertically spaced angular grooves formed in the exterior surface of said cylindrical body inwardly from the thin wall portion and a movable collar having an annular rib on its inner surface registrable with one of said annular grooves and wherein said collar has a depending annular flange spaced radially from the upper inner surface of said collar carrying said annular rib so as to provide clearance for said distortable ring-like member.

5. The bingo chip dispenser set forth in claim 4 and wherein said depending flange has cutaway areas circumferentially thereof so that a bingo chip dispensed from the dispenser can be viewed therethrough.

* * * * *